US006141817A

United States Patent [19]

Dawson

[11] Patent Number: 6,141,817

[45] Date of Patent: Nov. 7, 2000

[54] TOOTHBRUSH

[75] Inventor: Peter Leonard Dawson, Upton by Chester, United Kingdom

[73] Assignee: Cheesebrough-Pond's USA Co., division of Conopco, Inc., Greenwich, Conn.

[21] Appl. No.: 09/155,577

[22] PCT Filed: Mar. 26, 1997

[86] PCT No.: PCT/EP97/01607

§ 371 Date: Apr. 12, 1999

§ 102(e) Date: Apr. 12, 1999

[87] PCT Pub. No.: WO97/36517

PCT Pub. Date: Oct. 9, 1997

[30] Foreign Application Priority Data

Apr. 2, 1996 [GB] United Kingdom ..... 9606900

[51] Int. Cl.[7] ..... A46B 7/06

[52] U.S. Cl. ..... 15/167.1; 15/201; 15/176.3

[58] Field of Search ..... 15/167.1, 172, 15/176.1, 176.3–176.6, 167.2, 201, 202

[56] References Cited

U.S. PATENT DOCUMENTS

| | | | |
|---|---|---|---|
| 980,161 | 12/1910 | Knoller | 15/176.1 |
| 2,052,836 | 9/1936 | Lowy | 15/186 |
| 2,111,880 | 3/1938 | Waters | 15/176.6 |
| 2,706,825 | 4/1955 | Blakeman | 15/167.1 |
| 2,864,111 | 12/1958 | Rotceig | 15/167.1 X |
| 3,398,421 | 8/1968 | Rashbaum | 15/167.1 |
| 5,325,560 | 7/1994 | Pavone et al. | 15/167.1 X |
| 5,355,546 | 10/1994 | Scheier et al. | 15/167.2 |
| 5,839,149 | 11/1998 | Scheier et al. | 15/167.2 |

FOREIGN PATENT DOCUMENTS

| | | | |
|---|---|---|---|
| 640683 | 12/1963 | Belgium | 15/176.2 |
| 378304 | 8/1932 | United Kingdom | 15/176.4 |
| 92/17094 | 10/1992 | WIPO . | |
| 96/02165 | 2/1996 | WIPO . | |

*Primary Examiner*—Mark Spisich
*Attorney, Agent, or Firm*—Milton L. Honig

[57] ABSTRACT

A toothbrush comprising a head, a neck and a handle, the head comprising a readily flexed resilient member having a plurality of bristles arranged on one side thereof, and a rigid member depending from the neck, the resilient member resting on the rigid member and being arranged with an inner array of bristles between outer arrays of bristles on opposite sides thereof, the outer arrays being caused to splay divergingly from the resilient member as a consequence of deformation of the resilient member when the bristles are urged onto a tooth or gum surface.

2 Claims, 4 Drawing Sheets

TOOTHBRUSH

This invention relates to toothbrushes. In particular, it relates to flexible toothbrush heads which allow the bristles to optimise their cleaning configuration in use, and to methods of cleaning teeth using such special toothbrush heads.

Toothbrushes have been known since time immemorial. However, there has been a constant search for toothbrushes which seek either to improve the comfort and ease of brushing, or to improve the efficiency of brushing, by modifications to the bristles, brush head or handle.

It is known to mount the bristles of a toothbrush on a resilient head, and support that head from the brush handle in such a way that the resilient head deforms in use, thereby altering the bristle orientation. For example, in WO 94/13174, there is described a toothbrush having bristle tufts mounted on a readily flexed resilient member, which is prelerably in the form of an elongated sheet. In use, when the central portion of the brush is pushed against the occlusal surfaces of the user's teeth, with the resilient member deforming from its normally bowed position, thereby bringing into engagement with the teeth and gums the outer bristles on the head.

This brushing action is only part of the repertoire normally observed in users, and under more general and random brushing action splayed bristles, as distinct from bunched bristles, are recognised as providing high degrees of crevice intrusion, and therefore a high level of cleaning efficiency.

We have found that by suitably mounting onto a rigid member a flexible resilient member on which bristle tufts are mounted, it is possible to configure the brush head such that the bristles indine or splay in use in a controlled manner, thereby providing optimal cleaning.

Thus, according to its broadest aspect, there is provided a toothbrush comprising a head, a neck and a handle, the head comprising a readily flexed resilient member having a plurality of bristles arranged on one side thereof, and a rigid member depending from the neck, the resilient member resting on the rigid member and being arranged with an inner array of bristles between outer arrays of bristles on opposite sides thereof, the outer arrays being caused to splay divergingly from the resilient member as a consequence of deformation of the resilient member when the bristles are urged onto a tooth or gum surface.

According to a further aspect, there is provided a toothbrush comprising a head, a neck and a handle, the head comprising a readily flexed resilient member with a plurality of bristles mounted on one side thereof, and a rigid member depending from the neck, the rigid member having an upper surface on which the resilient member rests and a central longitudinal axis, the bristles on the resilient member being arranged with an inner array of bristles between outer arrays of bristles on opposite sides thereof, the readily flexed resilient member being mounted along the central longitudinal axis of the rigid member, the resilient member being free to deform adjacent the central longitudinal axis of the rigid member.

In such an embodiment, when for example the brush is not in use, the resilient member adjacent the central longitudinal axis of the rigid member, which may support the outer arrays of bristles, may not be directly supported by the rigid member. As a result, in use it may be free to deform, causing the effects described herein.

Conveniently, both the inner and outer arrays of bristles may comprise one or more longitudinal rows of closely spaced adjacent bristle tufts.

The resultant deformation of the resilient member adjacent the central longitudinal axis of the rigid member may cause the outer arrays of bristles to incline relative to the inner array, in a direction which diverges from the inner array.

In certain embodiments, the readily flexed resilient member may be supported on the rigid member along the whole length of the central longitudinal axis of the rigid member. In a preferred embodiment, the resilient member may be mounted on but not attached to the central longitudinal axis of the rigid member, but additionally mounted on and actually attached to the brush head by attachment to one or more lateral extensions of the rigid member, which may extend perpendicular to the central longitudinal axis. Such lateral extensions of the rigid member may be for example at one or both ends of the brush head, or in the middle of the brush head.

The brush according to the invention is designed so that in use at least some of the outer bristles of the-bristle array may be caused to splay outwards when the inner array of bristles are brought into contact with teeth and gums. In the context of the invention, the "inner array" of bristles may conveniently be one or more (for example two) longitudinal rows of bristle tufts. This effect may be caused by the configuration of the brush head; when the inner array of bristles are brought into contact with the teeth or gums of the user, the resilient member on which they are mounted is supported and held in place by the central longitudinal axis of the rigid member, which does not allow the resilient member immediately underneath the inner bristles to deform.

In contrast, the resilient member underneath the outer bristle array is not similarly constrained, and it is free to deform as a result of pressure applied to the end of the bristles remote from the resilient member. As a result of this deformation, the resilient member may be caused to deform for example to an arc or angled shape, with the inner bristles remaining in their original position, but the outer bristles being forced downwards with regard to their original position. This downward movement of the outer bristles may also cause them to splay with regard to their original orientation, thereby pointing in a diverging manner relative to their original configuration. This is thought to provide the benefit of improved crevice intrusion of the bristles, in particular the outer bristles in the bristle array, between the user's teeth, thereby improving cleaning efficiency.

In preferred embodiments of the invention, the central longitudinal axis of the brush may comprise an elevated surface, such as a ridge, which may be edged or flat surfaced, and which runs longitudinally along the brush head, and is located on the upper surface of the rigid member, contacting in use the under side of the resilient member.

Preferably, the bristles of the toothbrush are anchored to the readily flexible resilient member in a series of tufts, and extend from the resilient member in parallel to each other, and in a direction perpendicular to the surface of the resilient member, when the brush is not in use. The bristles may be manufactured from any material used in the art to make toothbrush bristles; preferred materials include nylon 6.12, or polybutyl terephthalate.

The resilient material on which the bristles are mounted can conveniently be any natural or synthetic elastomeric material, including for example low or high density polyethylene, tetrafluore ethylene, polyurethane, polypropylene, or synthetic rubber. The bristle tufts can be mounted on or in the resilient member by suitable manner, such as injection moulding techniques, or by mounting the bristles mechanically, adhesively, or by fusion onto or into the resilient member.

The invention will now be described by way of example only, in which.

Figure 1:
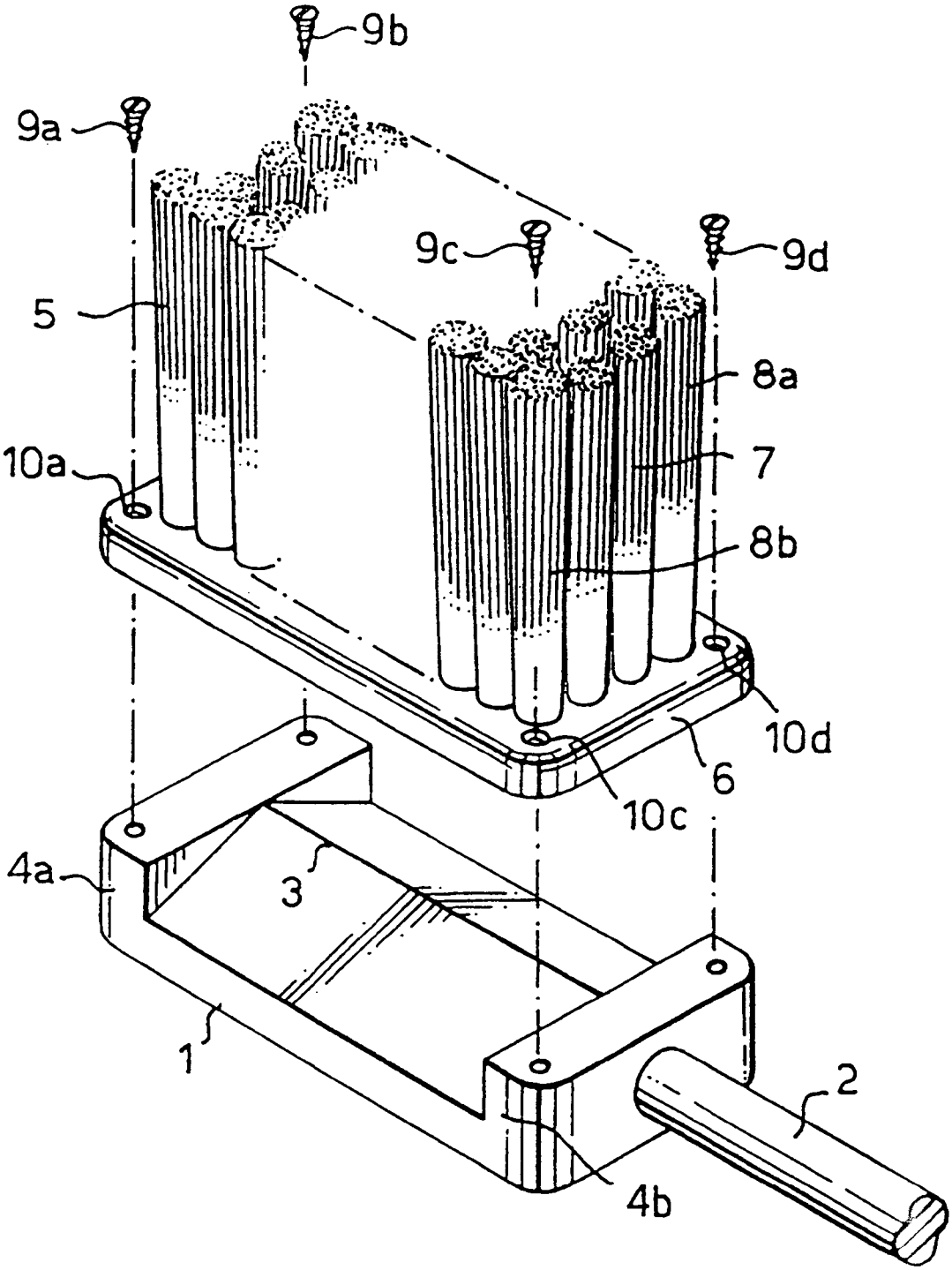
FIG. 1 shows a perspective exploded schematic view of a configuration of toothbrush head according to the invention.

Referring to FIG. 1, there is shown the head of a toothbrush, with the handle omitted. The head comprises a rigid member comprising a solid base portion 1, having attached thereto at one end a neck portion 2, for attachment to a brush handle (not shown). Base portion 1 and neck 2 have been integrally moulded from a rigid material, preferably a rigid plastics material, such as polypropylene, though they could as easily be manufactured from styrene acrylonitrile copolymer. Base portion 1 has longitudinal parallel sides, and a "gables end" shape in cross section, the top of the gables being a ridge 3, on which the resilient material supporting the bristles rests. Ridge 3 in this embodiment represents the central longitudinal axis of the brush, running longitudinally and centrally along the brush head, and also being located on the upper surface of the rigid base portion adjacent the under side of the resilient member.

Base portion 1 is shaped so as to have two end portions 4*a*, 4*b*, which are essentially rectangular in transverse cross section. The brush head including end portions is typically 28 mm long and 13 mm wide, and end portions 4*a*, 4*b* are typically 13 mm wide, 6 mm high, and 3 mm deep.

A plurality of schematically represented bristle tufts, 5, are supported on a resilient material base 6, made of polypropylene. The bristles are configured with an inner array 7 which comprises a longitudinal straight row of adjacent bristle tufts, having an either side an outer array, 8*a*, 8*b*, which comprises a longitudinal straight row of adjacent bristle tufts. The resilient material 6 may be attached to end portions 4*a*, 4*b* of the brush head, for example by plastic rivets 9*a*, 9*b*, 9*c*, 9*d* which penetrate the resilient materials through holes 10*a*, 10*b* (not shown), 10*c*, 10*d*, in resilient material 6, and lock into cooperating holes on base portion 1.

In use, as the user manipulates the brush head in the mouth, the inner array of bristles 7 will have a cleaning action on the teeth, but because of the action of ridge portion 3 on the underside of the resilient material 6, the inner array of bristles 7 are maintained, at least at a position on or close to ridge 3, in a direction which is substantially perpendicular to the plane of the brush head, and in their original orientation. However, the resilient material portion of the brush which supports the outer array of bristles 8*a*, 8*b*, is at least in part not directly supported by the rigid base portion 1, and as a result is free to deform in use under a pressure applied to the tops of the outer arrays of bristles 8*a*, 8*b*. As a result, the deformed configuration of the resilient material causes the bristles to have a splayed configuration. However, the rigid sloping sides of base portion 1 limit the deformation of the resilient material 6 possible, and thereby act to restrict the degree of splaying of the bristle configuration.

This configuration may confer benefits to the brush in terms of its ability to penetrate crevices in the mouth.

It is highly preferred that the material which constitutes the resilient member is in fact more resilient, and more deformable than the material from which the bristles are manufactured, in order to maximise the readiness of the resilient material to deform in use, and therefore the ability of the brush bristles to splay.

Figure 2:
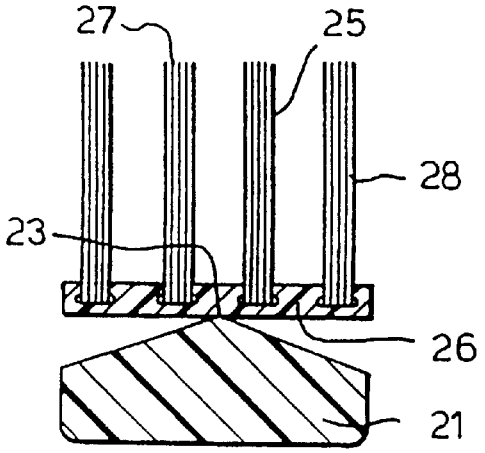
FIG. 2 shows a schematic cross sectional view of a toothbrush head according to the invention.

FIG. 2 shows a transverse cross section of a brush similar to that shown in FIG. 1, except that the end portions of the base portion are not shown. The rigid member base portion 21 of this embodiment likewise has a gables end cross section, with a plurality of bristle tufts 25 attached to a resilient member 26, which rests on ridge 23. In this embodiment, the inner array of bristles 27 comprises two longitudinal straight rows of adjacent bristles tufts, whilst the outer array 28 comprises a single longitudinal straight row of bristle tufts on each side of the inner array 27.

Figure 3:
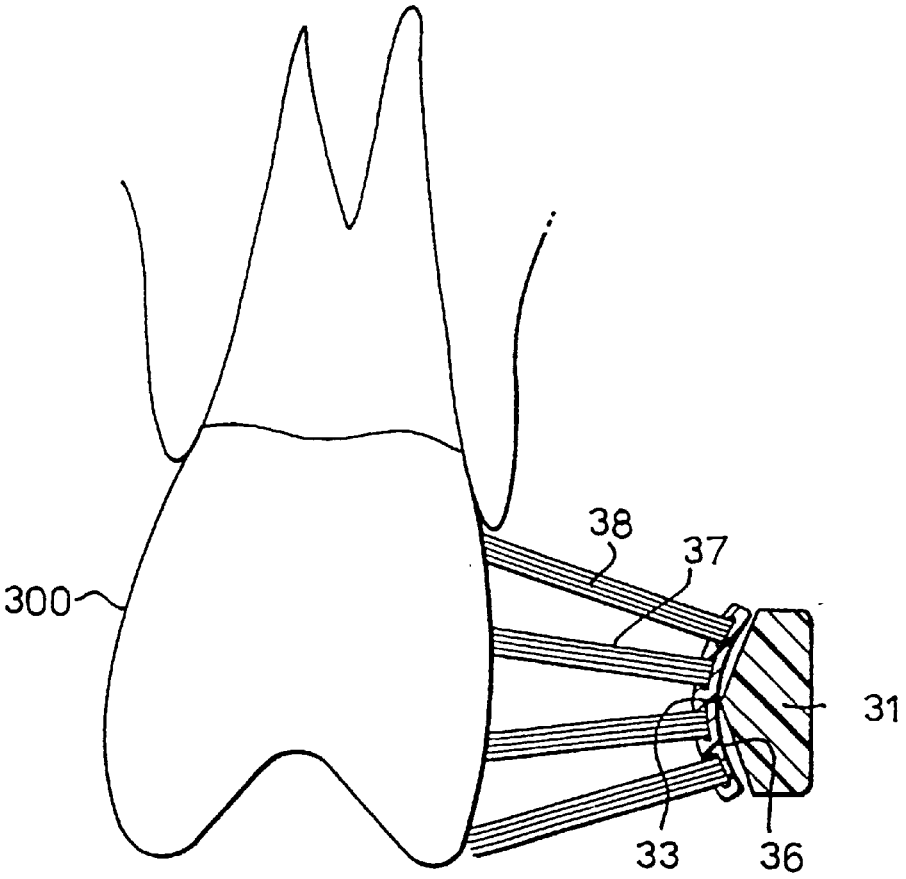
FIG. 3 shows a schematic cross section view of the brush head of FIG. 2 in use.

FIG. 3 shows the brush of FIG. 2 in use, being pressed up against a tooth surface 300. As can be seen, in use the resilient member 36 is unable to deform near its centre where it is held in place by ridge 33 resting on base portion 31. As a result, the inner array of bristles 37 are retained at essentially the same angle and orientation relative to the base portion 31. However, the outer arrays 38, not being so constrained by the rigid base portion 31 below the resilient member, are free to incline and splay relative to the inner array 37.

Figure 4:
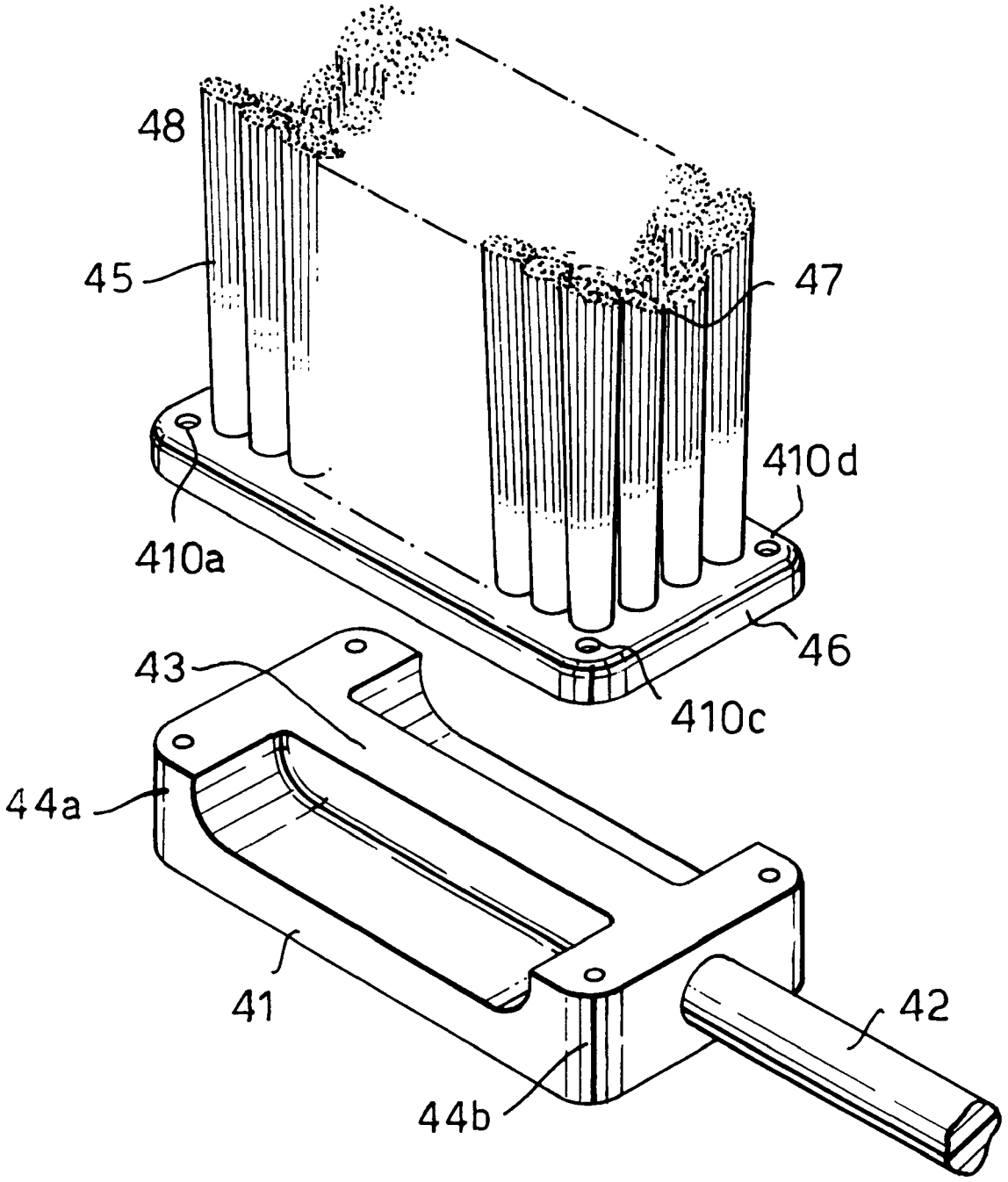
FIG. 4 shows a schematic exploded perspective view of a further embodiment of toothbrush head according to the invention.

FIG. 4 shows an alternative configuration of toothbrush head according to the invention.

In this embodiment, the toothbrush head likewise has a rigid base member 41, and two end portions 44*a*, 44*b*. Brush neck 42 is attached to end portion 44*b*. Resilient member 46 has attached to it a plurality of bristle tufts 45; in this embodiment the inner array 47 comprise two longitudinal straight rows of adjacent bristle tufts, whilst the outer array 48 comprises a longitudinal straight row of adjacent bristle tufts on each side of the inner array 47. Resilient member 46 may conveniently be attached to rigid base member 41 by a series of pegs (not shown), which can conveniently pass through holes 410*a*, 410*b* (not shown) 410*c*, 410*d*, and lock into corresponding holes on the rigid base member 41 which extend perpendicularly from flattened edge 43 (incorporating the central longitudinal axis of the brush head), by conventional means.

The bristles 47 of this embodiment are in the form of a sculptured trim, where the bristles are not of the same length. In this embodiment the inner array of bristles 47 is shorter than the outer array 48, and additionally the ends of the bristles are shaped so as to have a "V" configuration when viewed from one end of the brush head. Other bristle trims are generally envisaged as different embodiments of the invention, such as for example a ripple trim.

Figure 5:
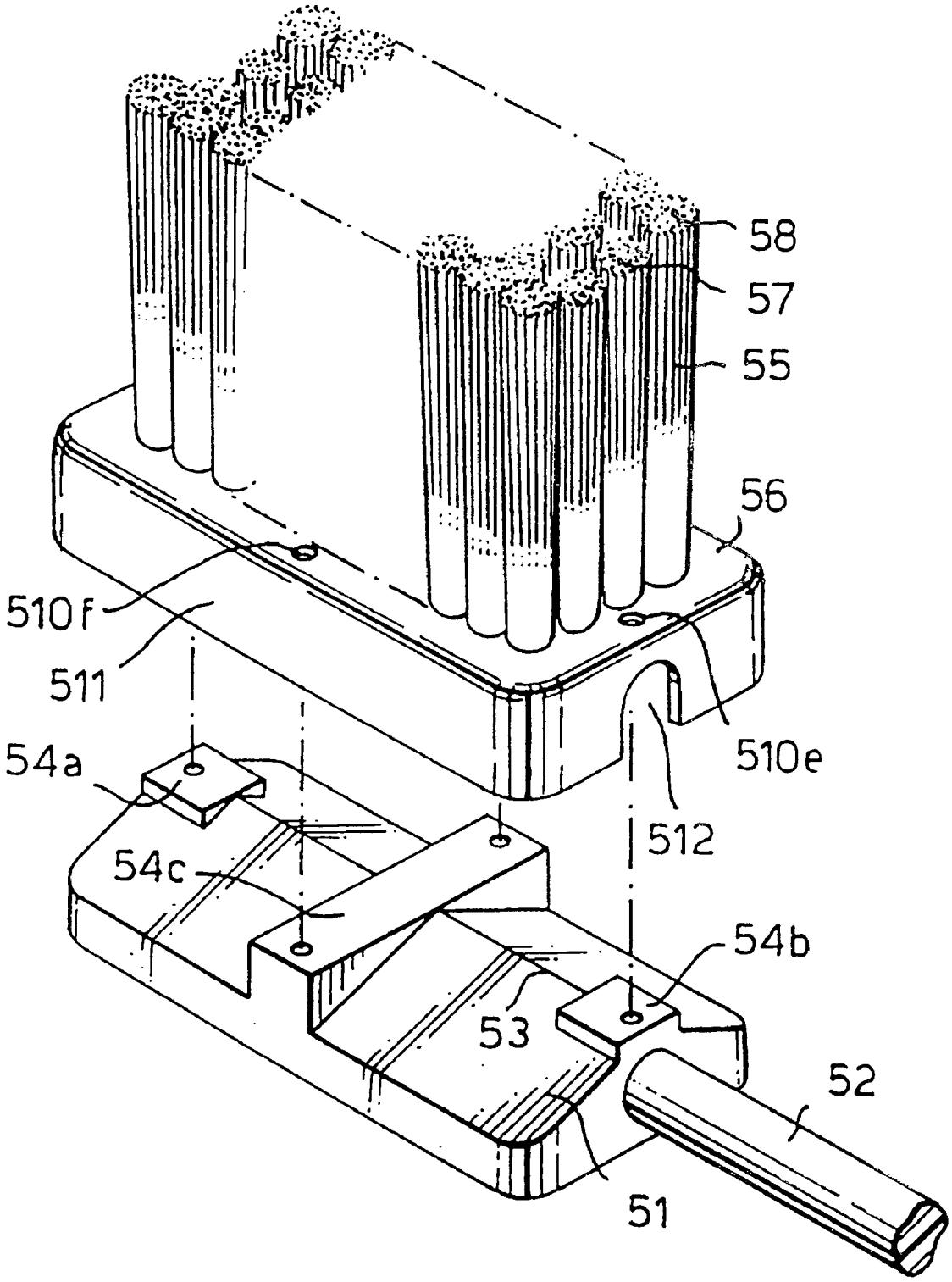
FIG. 5 shows a schematic exploded perspective view of another embodiment of toothbrush head according to the invention.

FIG. 5 represents a further and preferred configuration of toothbrush according to the invention.

In this embodiment, the rigid base member 51 has a "sharp edge" ridge portion 53, on which the underside of resilient member 56 rests. Brush neck 52 is attached to the end of rigid base member 51. Resilient member 56 may additionally rest on, and be anchored to, end portions 54*a*, 54*b* and in addition raised cross member 54*c*, which is located laterally across the middle of the brush head, and extends perpendicularly to the central longitudinal axis of the brush head, which runs along ridge 53. Conveniently this may be done by pegs or studs, which may pass through holes 510*e*, 510*f*, 510*g* (not shown) and 510*h* (not shown) in resilient member 56, and lock into cooperating holes in end portions 54*a*, 54*b* and cross member 54*c*, by conventional means.

Resilient member 56 has attached to its upper side bristle tufts 55 (shown schematically), which comprise an inner array 57 of two longitudinal straight rows of adjacent bristle tufts, and an outer array 58 which comprises a longitudinal straight row of adjacent bristle tufts on each side of the inner array 57. In this embodiment the bristles of inner array 57 are shorter than those of the outer array, the bristles in each array being of uniform length with each other.

In use, the resilient member may be constrained by the end portions 54*a*, 54*b*, cross member 54*c* and ridge 53, but may be free otherwise to deform, with the four corners of the array in particular being capable of deforming and therefore causing inclination of the bristles mounted on these parts of the resilient member, as previously described.

A preferred feature of this embodiment, which may be equally applied to other embodiments, is the elastomeric skirt 511, which depends from the resilient member 56 in a direction opposite that in which the bristles point, and conveniently covers the sides of the rigid base member 51. The elastomeric skirt can conveniently be attached to the periphery of rigid member 51, for example by ultrasonic welding thereto. Alternatively, the elastomeric skirt may be attached to a back plate which runs under the rigid member 51 on the side opposite the brush head bristles, and attached thereto by for example ultrasonic welding, or gluing. Skirt 511 has molded into it access hole 512, which provides the toothbrush neck 52 access to the rigid base member 51. The elastomeric skirt 511 can confer advantages to the brush head in terms of hygiene, gum massaging capabilities and also its comfort to the user in use.

As the skilled person will appreciate, many variations on the invention are possible without departing from the spirit of the invention. For example, the brush head may be any convenient shape, such as for example triangular, diamond shaped or arrow head shaped, in addition to rectangular. In addition whilst the schematic representations have often been drawn as being highly angular, the corners on brush embodiments, in particular on the rigid member, may be rounded for extra comfort.

What is claimed is:

1. A toothbrush comprising a head, a neck and a handle, the head comprising a readily flexed resilient member with a plurality of bristles mounted on one side thereof, and a rigid member depending from the neck and having at least one lateral extension attached to the resilient member, the rigid member having an upper surface on which the resilient member rests and a central longitudinal axis including an elevated surface running longitudinally along at least a portion of the brushhead located adjacent the resilient member, the bristles on the resilient member being arranged with an inner array of bristles between outer arrays of bristles on opposite sides thereof, the readily flexed resilient member being mounted along the central longitudinal axis of the rigid member, the resilient member being free to deform adjacent the central longitudinal axis of the rigid member.

2. A brushhead according to claim 1 wherein the resilient member further comprises an elastomeric skirt flanking the head and covering sides of the rigid member.

* * * * *